United States Patent [19]

Cuculo et al.

[11] Patent Number: 4,840,673

[45] Date of Patent: Jun. 20, 1989

[54] ANISOTROPIC CELLULOSE ARTICLES, FIBERS, AND FILMS AND METHOD OF PRODUCING SAME

[75] Inventors: John A. Cuculo; Michael H. Theil; Kap S. Yang; Yue S. Chen, all of Raleigh, N.C.

[73] Assignee: North Carolina State University, Raleigh, N.C.

[21] Appl. No.: 166,041

[22] Filed: Mar. 9, 1988

Related U.S. Application Data

[62] Division of Ser. No. 937,034, Dec. 2, 1988, Pat. No. 4,750,939.

[51] Int. Cl.[4] ..... C08L 1/00; D01F 2/00

[52] U.S. Cl. ..... 106/198; 106/203; 264/187; 264/212

[58] Field of Search ..... 106/177, 203, 198; 264/187, 212

[56] References Cited

U.S. PATENT DOCUMENTS

| | | | |
|---|---|---|---|
| 625,033 | 5/1899 | Hoyne | 264/78 |
| 1,301,652 | 4/1919 | Clayton et al. | 536/56 |
| 1,691,345 | 11/1928 | Fulton | 536/56 |
| 2,009,015 | 7/1935 | Powers et al. | 427/339 |
| 4,278,790 | 7/1981 | McCormick | 536/84 |
| 4,367,191 | 1/1983 | Cuculo et al. | 264/187 |
| 4,370,168 | 1/1983 | Kamide et al. | 106/177 |
| 4,412,059 | 10/1983 | Krigbaum et al. | 528/192 |
| 4,456,638 | 6/1984 | Petcavich | 428/1 |
| 4,464,323 | 8/1984 | O'Brien | 264/187 |
| 4,486,119 | 12/1984 | Kamide et al. | 106/177 |
| 4,501,886 | 2/1985 | O'Brien | 536/57 |
| 4,581,399 | 4/1986 | Yoon | 524/246 |
| 4,659,470 | 4/1987 | Caneba et al. | 264/45.5 |
| 4,750,939 | 6/1988 | Cuculo | 106/203 |

FOREIGN PATENT DOCUMENTS 2340344 2/1977 France .

OTHER PUBLICATIONS

"Liquid Crystalline Cellulose Derivatives", pp. 179–192, vol. 37, *Journal of Applied Polymer Science: Applied Polymer Symposium,* by Derek G. Gray, (1983).

"Solution Studies of Cellulose in Lithium Chloride and N, N-Dimethylacetamide", pp. 2394–2401, vol. 18, *Macromolecules,* by McCormick, Callais, and Hutchinson, Jr., (1985).

*Primary Examiner*—Theodore Morris

*Attorney, Agent, or Firm*—Bell, Seltzer, Park & Gibson

[57] ABSTRACT

Lyotropic mesophase (liquid crystalline) solutions of cellulose are formed in an ammonia/ammonium thiocyanate solvent. The nature of the solution can be controlled to selectively produce lyotropic cellulose mesophases having either nematic or cholesteric character. High strength, high modulus fibers are produced from a lyotropic mesophase solution of cellulose essentially in the nematic phase. The films are prepared from mesophase solutions of cellulose that are mainly in the cholesteric phase.

22 Claims, 5 Drawing Sheets

Minimum cellulose concentration, Cp, for mesophase formation as determined by solvent composition : cellulose Dp, 210; storage time at 25°C, 30 days.

Pitch size, P, dependence on solvent composition: Cellulose concentration, 10g/100ml; cellulose Dp, 210; storage time at 25°C, 17 days.

ANISOTROPIC CELLULOSE ARTICLES, FIBERS, AND FILMS AND METHOD OF PRODUCING SAME

This application is a division of No. 06,937,034 filed 12/02/88 now U.S. Pat. No. 4,750,939.

FIELD AND BACKGROUND OF THE INVENTION

This invention relates to anisotropic cellulose solutions and to fibers and films produced therefrom. More specifically, the present invention relates to the production of anisotropic cellulose solutions in the nematic phase as the preferred precursor to high strength, high modulus cellulose fibers and films.

Anisotropic spinning solutions have been recognized as being useful for forming fibers and films of high tenacity and modulus For example, anisotropic polyamide spinning solutions such as poly(p-phenylene terephthalamide) have been employed in producing high tenacity aramide fibers known commercially as Kevlar ® fibers, as disclosed for example in Kwolek U.S. Pat. Nos. 3,671,542, 3,819,587, and Re. 30,352.

It has also been observed that cellulose and cellulose derivatives can form anisotropic solutions. Chanzy[1], Gilbert[2], and Conio[3] have reported that such anisotropic solutions could also be obtained from cellulose in various solvents. Gray[4] lists a number of cellulose derivatives and solvent systems which have been reported to form anisotropic cellulose derivative solutions. References:

*(1) H. Chanzy and A. Peguy, *J. Polym. Sci.*, Polym. Phys. Ed., 18, 1137 (1980).

*(2) D. L. Patel and R. D. Gilbert, *J. Polym. Sci.*, Polym. Phys Ed , 19, 1231 (1981).

*(3) C. Conio, P. Corrazza, E. Vianchi, A. Tealdi and A. Ciferri, *J. Polym. Sci.*, Polym. Lett. Ed., 22, 273 (1984).

*(4) Gray, Derek G., *Liquid Crystalline Cellulose Derivatives*, Journal to Applied Polymer Science Applied Polymer Symposium, 37, 179–192 (1983).

Anisotropic cellulose derivative solutions have also been reported to form high tenacity, high modulus cellulosic fibers. See for example Panar and Willcox French Pat. No. 2,340,344; Kamide, et al U.S. Pat. No. 4,370,168; and O'Brien U.S. Pat. Nos. 4,464,323 and 4,501,886.

While it has been shown, as noted above, that anisotropic solutions of cellulose are capable of forming high performance cellulose fibers, insofar as we are aware this technology has not been put into practice for producing cellulosic fibers on a commercial scale. This is believed to be attributable, at least in part, to certain limitations and disadvantages of the known cellulose/-solvent systems. In certain of the known systems, anisotropic solutions containing the nematic phase are difficult to form (often requiring external stimuli such as magnetic fields). Further disadvantages or limitations of the known systems are lack of sufficient cellulose solubility to obtain wholly anisotropic solutions and the necessity of a pretreatment of the cellulose to activate it prior to its dissolution in the LiCl/DMAC system. In the case of the N-methylmorpholine-N-oxide (NMMO) solvent there is the problem of dealing with a solid solvent at room temperature and the need to melt it and carefully control its temperature. Further, the fact that NMMO is an amine oxide requires extreme safety precautions in its handling during extrusion and especially during recovery and recycling. The significant degree o polymerization (DP) loss of the cellulose at the spinning temperatures is another limitation.

The present invention, in one of its aspects, employs an advantageous solvent system based upon ammonia and ammonium thiocyanate, which readily forms anisotropic cellulose solutions which are stable and maintain anisotropic properties over extended periods of time.

Cuculo et al in U.S. Pat. No. 4,367,191, issued Jan. 4, 1983, have previously disclosed that ammonia/ammonium thiocyanate is an effective solvent for cellulose. The solvent dissolves high degree of polymerization cellulose to form solutions of high concentrations. The solvent is convenient, easy to prepare, inexpensive, safe, nondegrading towards cellulose and easily used at room temperature. Also, the cellulose requires no pretreatment for dissolution. The cellulose that is dissolved by this system may come from practically any source including cotton, wood pulp, and the dissolving pulp normally used by rayon producers.

In accordance with the Cuculo et al patent, the disclosed solutions of cellulose in ammonia/ammonium thiocyanate solvent were isotropic. These isotropic cellulose solutions were wet spun to produce cellulose fibers having properties essentially equivalent to conventional rayon.

SUMMARY OF THE INVENTION

We have now discovered that under certain conditions, cellulose forms a lyotropic mesophase (liquid crystalline solution) in the ammonia/ammonium thiocyanate solvent. This discovery is significant because, as in the production of aramide fibers, the potential for making ultraoriented fibers is greater from a highly ordered yet fluid mesophase system than from a conventional isotropic solution.

We have found further that we can control the nature of the lyotropic mesophase solutions by changing the ammonia/ammonium thiocyanate ratio of the solvent, the cellulose concentration, and by varying the temperature of the system. This makes it possible to selectively produce lyotropic cellulose mesophases in either the nematic or cholesteric phase. This is significant because we have found the nematic phase to be the preferred precursor to super high strength/high modulus cellulose fibers and films.

In forming fibers and films from conventional isotropic systems, the structure and properties of the fiber are determined by events that occur during the extrusion process and the after-processes such as drawing and heat setting. When forming fibers from liquid crystalline systems, one relies on the partial ordering of the mesophase system to contribute to the creation of a highly oriented, highly ordered fibrous product. Panar and Willcox (FR No. 2,340,344) have shown that mesophase solutions of cellulose derivatives in various solvents can produce cellulose derivative fibers with improved tenacity over that obtained from conventional isotropic solutions. O'Brien (U.S. Pat. No. 4,464,323 and U.S. Pat. No. 4,501,886) has shown that mesophase solutions of cellulose triacetate can also produce fibers with improved tenacity compared with that obtained from conventional isotropic solutions. These fibers are saponified under tension. The regenerated cellulose fibers so produced from this process had higher strengths and higher moduli than did the original cellulose triacetate fibers.

Cellulose chains are chiral and they produce a twisted arrangement of cellulose molecules. In cellulose solutions the chiral chains usually lead to the twisted arrangement of cellulose molecules known as a cholesteric mesophase. We can compensate for chirality and get untwisted mesophases, i.e. the nematic phase. Mesophase solutions of cellulose may be useful in producing films, fibers and other articles, and the physical properties of the resulting product can be tailored to particular end uses by controlling the pitch and/or other characteristics of the cholesteric phase. A cellulose mesophase solution possessing the nematic arrangement, because of the highly ordered longitudinal, uniaxial parallel arrangement of molecules, is the preferred precursor for the formation of super high strength/high modulus fibers and films.

Cellulose solutions in the nematic phase are formed in an ammonia/ammonium thiocyanate solvent essentially immediately after dissolution of the cellulose. This can be done by proper selection of the cellulose concentration and solvent composition and without the need of an outside stimulus, such as from a magnetic field or from shear or flow conditions. The cellulose solution is stable, as evidenced by the absence of a significant change in specific rotation and in turbidity over a two week observation period. Fibers extruded from the nematic phase solution possess values of modulus greater than rayon and near the lower range of values shown by Fortisan®.

Thus, the present invention, in one of its aspects, provides a lyotropic mesophase solution of cellulose which exhibits the nematic phase in the absence of external stimulus. In another aspect, the present invention provides a lyotropic mesophase solution of cellulose in an ammonia/ammonium thiocyanate solvent. The present invention also provides cellulose fibers and films produced from such mesophase solutions. In still another aspect, the present invention provides a process for forming a lyotropic cellulose mesophase solution, as well as processes for forming fibers and films therefrom. While the ammonia/ammonium thiocyanate solvent is the preferred solvent system for forming cellulose mesophase solutions in accordance with the present invention and for producing fibers and films therefrom, it is contemplated that other solvent systems can also be suitably employed.

BRIEF DESCRIPTION OF THE DRAWINGS

Some of the features and advantages of the invention having been described, others will become apparent from the detailed description and examples which follow and from the accompanying drawings, in which—

FIG. 2 shows the fingerprint pattern for 8 g of cellulose DP 210 dissolved per 100 mL of solvent in which the solvent composition is 28% of ammonia by weight to 72% ammonium thiocyanate by weight (28/72);

FIG. 3 shows the thread-like pattern formed immediately after dissolution (solvent composition 24.5/75.5 $NH_3/NH_4SCN$, cellulose concentration 14 g/100 mL, cellulose DP 450);

FIG. 4 shows the Schlieren texture formed immediately after dissolution (solvent composition 24.5/75.5 $NH_3/NH_4SCN$, cellulose concentration 14 g/100 mL, cellulose DP 450);

FIG. 5 shows the conjugated pattern which indicates a combination of nematic and cholesteric phases (solvent composition 27/73 $NH_3/NH_4SCN$, cellulose concentration 12 g/100 mL, cellulose DP 210, storage time at 25° C., 14 days);

FIG. 6 shows an aggregated anisotropic pattern formed immediately after dissolution (solvent composition 23.6/75/1.4 $NH_3/NH_4SCN/H_2O$, cellulose concentration 20g/100mL, hydrolyzed cellulose of DP 35);

FIG. 7 shows the spherulitic pattern (solvent composition 24/76 $NH_3/NH_4SCN$, cellulose concentration 14g/100mL, cellulose DP 210, storage time at 25° C., 20 days);

FIGS. 9 and 10 are photomicrographs showing the surface appearance of fibers produced from cellulose solutions with nematic and cholesteric phase contents, respectively; and wherein FIG. 9 shows the fiber surface of a fiber formed by extrusion with a wet spinner of a nematic solution (solvent composition 25.0/75.0 $NH_3/NH_4SCN$, cellulose concentration 16g/100mL, cellulose DP 210) and FIG. 10 shows the fiber surface of a fiber similarly formed from a cholesteric solution (solvent composition 29.3/70.7 $NH_3/NH_4SCN$, cellulose concentration 16g/100mL, cellulose DP 210);

DESCRIPTION OF THE ILLUSTRATED EMBODIMENTS OF THE INVENTION

Figure 1:
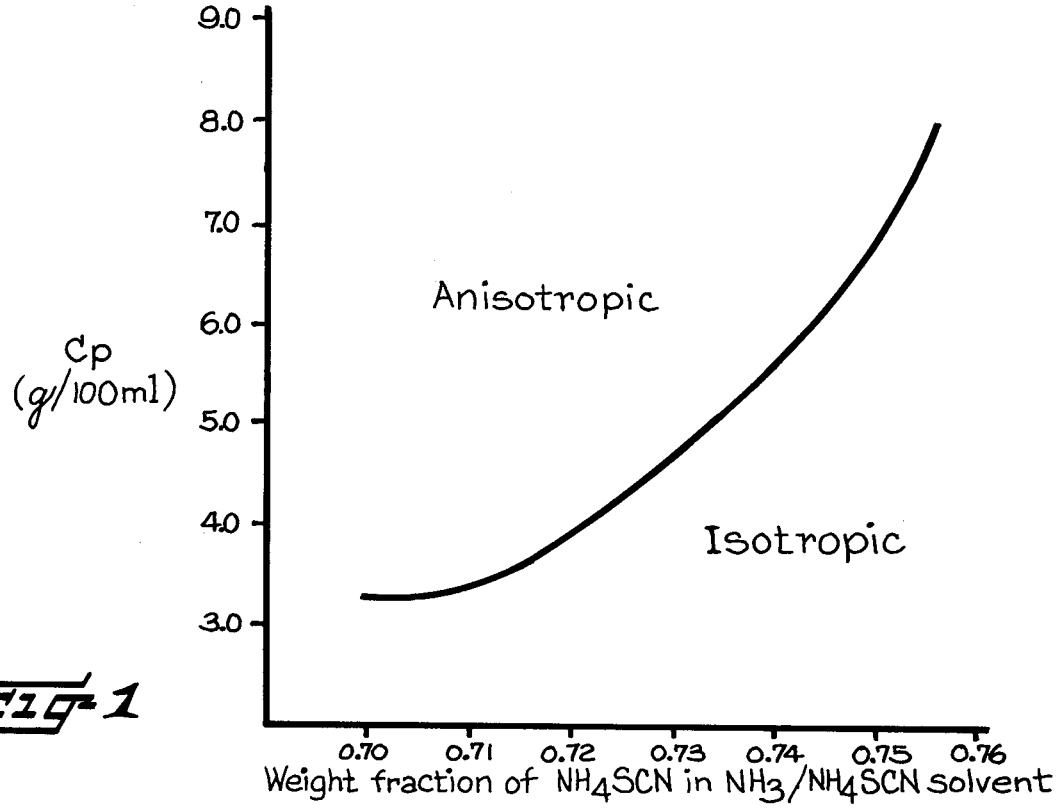
FIG. 1 is a graph illustrating the relationship of minimum cellulose concentration for mesophase formation and solvent composition.

In the ammonia/ammonium thiocyanate/cellulose system, the formation of a lyotropic cellulose mesophase has been observed to occur in cellulose solutions having cellulose concentrations greater than about 3.5g/100ml and the solvent containing 70 weight percent of ammonium thiocyanate or greater. As the solvent composition becomes richer in ammonium thiocyanate, the minimum cellulose concentration increases. Thus, anisotropic cellulose solutions form at lower cellulose concentration in the solvents that have lower ammonium thiocyanate content. The graph of FIG. 1 illustrates the increasing relationship between minimum cellulose concentration for mesophase formation and solvent composition.

We have also found that under conditions in which polymer-polymer interactions are minimized, the formation of a nematic phase is favored over a cholesteric phase. That is, if there is a reduction of interaction between chiral cellulose molecules, then the twisted layered structure that results from the polymer-polymer interaction of chiral chains may be also repressed. Thus formation of a cholesteric phase may be inhibited and the formation of a nematic phase favored. We have found that as the ammonium thiocyanate concentration in the solvent is increased from 70 percent to about 75 percent, the formation of the nematic phase is favored. As the ammonium thiocyanate concentration is increased significantly beyond about 75.5 percent, the solution has an increasing tendency toward cholesteric as evidenced by its return to high negative optical rotation. The preferred conditions for formation of the nematic phase appear to be at cellulose concentrations in the range of about 8g/100mL to about 16g/100mL and at a solvent composition of 24.5% ammonia/75.5% ammonium thiocyanate, at 25° C. Lowering the system temperature to 10° C. appears to increase the solvent composition range over which the system is nematic.

The cellulose solutions may be cast into films using conventional film casting processes and equipment and also spun into fibers using known processes such as wet spinning or dry jet wet spinning.

EXAMPLE 1—PREPARATION OF ANISOTROPIC CELLULOSE SOLUTIONS

Four different cellulose samples were used. Low molecular weight cellulose of DP 35 was prepared from a cellulose sample received from American Enka. Cellulose powder of DP 210, CC 41 microgranular grade, was obtained from Whatman Chemical Ltd. Cellulose pulp sheets of DP 450 and DP 765 from Avtex Fibers and ITT Rayonier respectively were cut into small pieces and shredded. Unless specifically stipulated otherwise, cellulose of DP 210 was used. The solvent compositions chosen for study were in the range of 70 to 80% (w/w) $NH_4SCN$ (0.33 to 0.47 mole fraction).

Solution Preparation

A known amount of cellulose was added to $NH_3/NH_4SCN$ solvent which had been placed in a vial equipped with a tight cap. The mixture was evenly dispersed using a Vortex Genie agitator (Fisher Sci. Co.) for up to 5 minutes. The mixture was then placed in dry ice for 24 hours and then was warmed in 50° C. water to bring about flow. The solution was then observed under a polarizing microscope. If undissolved cellulose particles were present, they were observed and noted, and the solution was frozen in dry ice for another 24 hours. When complete dissolution of the cellulose was ascertained, the samples were routinely frozen and then stored at 25° C. This ensured that all samples had similar thermal histories and that a precise reference time frame was established. Some of the solutions were transferred to rectangular quartz cells (path length 2 mm) using a syringe. These samples were used to identify the cholesteric structure by He-Ne laser beam diffraction. All solution concentrations are reported as percent weight of cellulose per volume of $NH_3/NH_4SCN$ (100×g/mL solvent).

Figure 2:
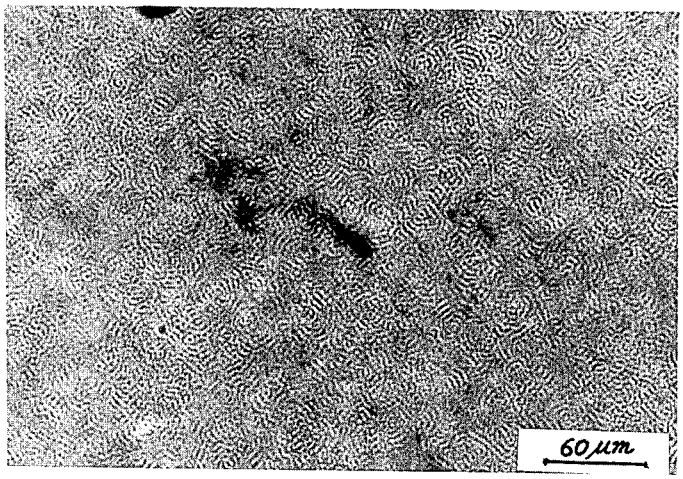
FIGS. 2–7 are photomicrographs showing the characteristic patterns exhibited by various cellulose mesophase solutions under a polarizing microscope, and more particularly.
Figure 3:
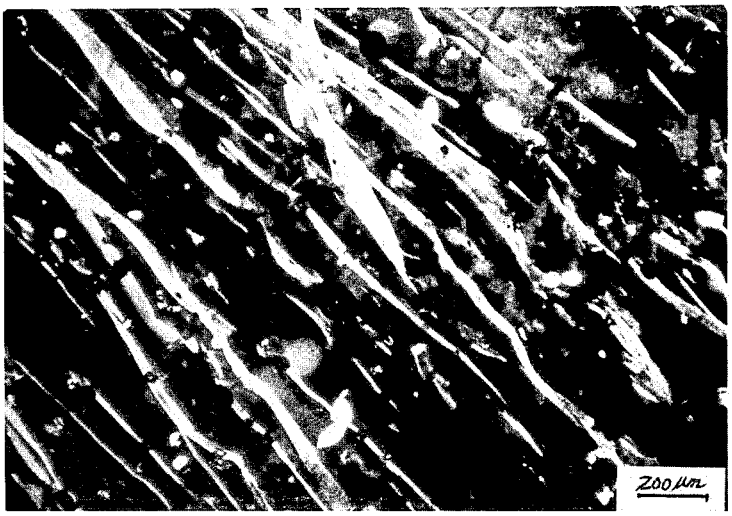
Figure 4:
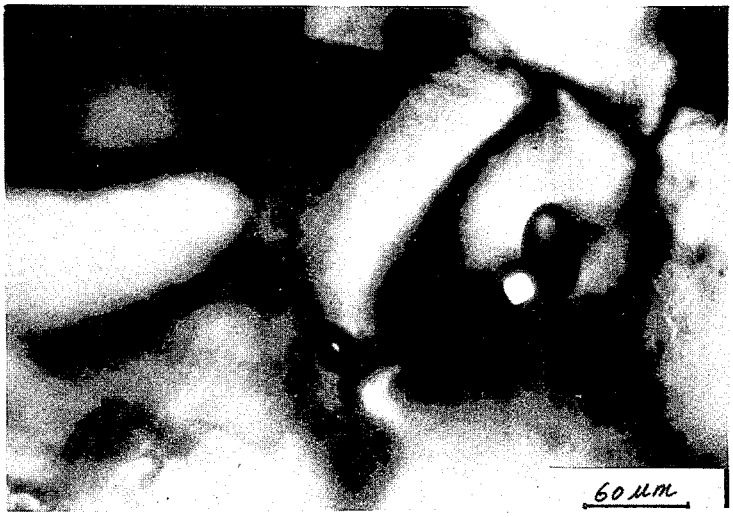
Figure 5:
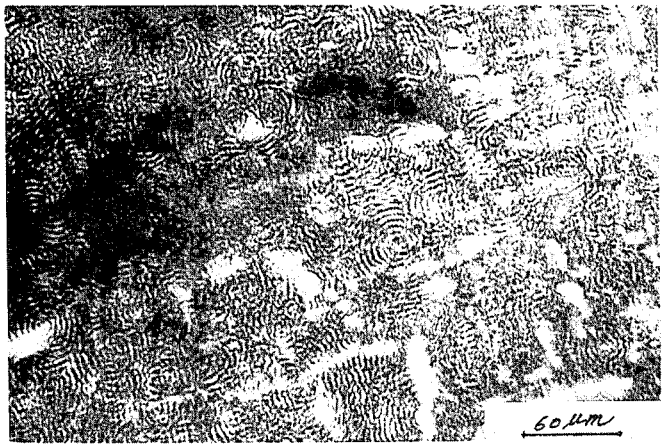
Figure 6:
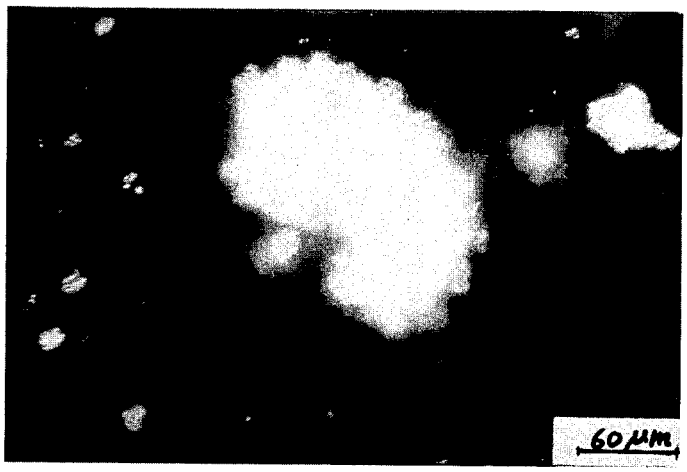
Figure 7:
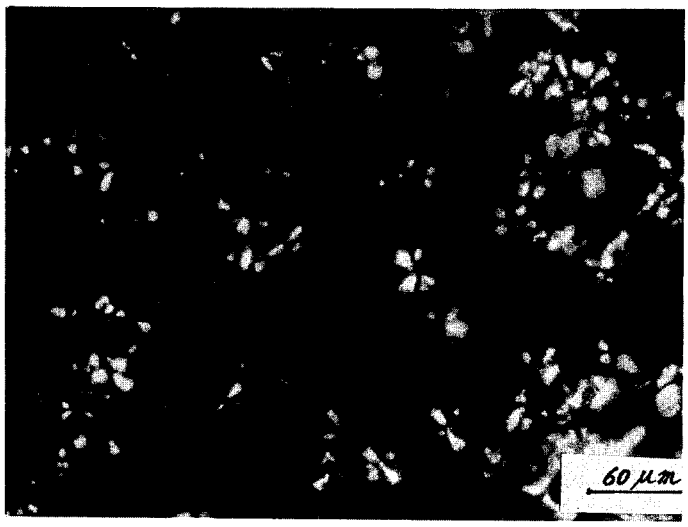

The cellulose solutions were examined microscopically, and several kinds of patterns were observed in the $NH_3/NH_4SCN$/cellulose mesophase solutions. The patterns are classified as finger print (FIG. 2), thread-like (FIG. 3), Schlieren texture (FIG. 4), conjugated (combinations of different kinds of patterns) (FIG. 5), aggregated anisotropic (FIG. 6), and spherulitic (FIG. 7) patterns. The occurrence of these patterns depends on composition of the solvent, cellulose concentration, storage time, DP of the cellulose, dissolution technique, and prior chemical treatment such as hydrolysis and the storage temperature, which was fixed at 25° C.

The finger print pattern was observed in solutions of solvent containing less than approximately 75.5% (w/w) $NH_4SCN$ for all cellulose concentrations studied. The cellulose anisotropic solutions forming the finger print pattern were identified as cholesteric mesophases. First, the anisotropic solutions showed high negative specific rotation compared with the low specific rotation of +35° for cellobiose in the same solvent. Further, a linear relationship was found between the specific rotation and the reciprocal of the square of the wave length. Such a relationship is interpretable by de Vries'[5] theory to show that these mesophases were cholesteric Second, the ring patterns of He-Ne laser beam diffraction also provided evidence of a cholesteric anisotropic phase. All of the anisotropic solutions which resulted in the formation of the finger print pattern were turbid. The turbidity increased as the negative specific rotation increased.

*(5) H. de Vries, Acta Crystallogr., 4, 219 (1951).

The thread-like pattern observed in the cellulose solution containing approximately 75.5% (w/w) $NH_4SCN$ appeared immediately following dissolution and persisted throughout a two week period. The length of time this pattern persisted depended on the cellulose concentration. The solutions in which the thread-like pattern appeared showed fairly low negative specific rotation There was almost no change in specific rotation with storage time up to 213 hours. Interestingly, a distinct fibrillar texture was observed under a polarizing microscope when cellulose solutions of the above solvent composition were extruded from a syringe. This observation supports the general concept that the nematic phase is a precursor for a well ordered fiber structure.

The conjugated pattern was observed in solutions of moderate cellulose concentrations, 12g/100mL–16g/100mL, in solvents containing less than 75.5% $NH_4SCN$ or in solutions of fairly high cellulose concentration, 18g/100mL, prepared from solvents containing approximately 75.5% $NH_4SCN$.

The aggregated phase pattern was formed within a few minutes after dissolution for solutions prepared from hydrolyzed cellulose of DP 35 at the solvent composition 23.6/75/1.4 ($NH_3/NH_4SCN/H_2O$).

The spherulitic phase pattern appeared in solutions prepared from solvents containing greater than approximately 75.5% $NH_4SCN$ after as little as five days or in solutions prepared from solvent containing approximately 75.5% $NH_4SCN$ if they were stored for approximately 30 days. The density of spherulite content increased with increasing $NH_4SCN$ concentration. The anisotropic cellulose solutions containing the spherulitic pattern showed high negative specific rotation. On the basis of this high negative specific rotation, the cellulose solutions containing the spherulitic pattern were established as cholesteric.

Several interesting observations were made by varying the ratio of $NH_3/NH.SCN_4$ in the $NH_3/NH_4SCN$/cellulose system. Both the finger print and conjugated patterns were readily observed in the cellulose solution prepared from solvents containing less than approximately 75.5% $NH_4SCN$. The former occurs at lower and the latter at higher cellulose concentrations. The thread-like pattern appeared most frequently in the solution prepared from solvent containing approximately 75.5% $NH_4SCN$. The conjugated pattern was also observed at this same solvent composition if the cellulose concentration was increased. The spherulitic pattern appeared in the solution prepared from solvent containing more than approximately 75.5% $NH_4SCN$ and stored for a relatively short time or prepared from solvent containing 75.5% $NH_4SCN$ and stored for a relatively long time. Cellulose concentrations of 12, 14, 16 and 18g/100mL were used.

A reduction in viscosity with a concomitant deaeration of the nematic cellulose solutions can be obtained by centrifugation. The following procedure was used. The cellulose solutions prepared from solvent containing 75.5% weight fraction of $NH_4SCN$ showed the nematic phase in the range of cellulose concentration prepared (8–13g/100mL). Centrifugation was performed at 15000 rpm (producing a G force of ca. 27,000) for one hour at 25° C. on solutions that were stored for 30 days. All the solutions became less viscous and did not show any phase separation. Concurrently, air bubbles were no longer observed in the solutions. Among the solutions, those of relatively low cellulose concentration.(8 0, 8.5, 9.0, and 9.5g/100mL) transformed into isotropic phase while the solutions of relatively high cellulose concentrations (10, 11, 12, 13g/100mL) remained nematic. After the solutions were stored two more days, solutions of cellulose concentration above 8.5g/100mL showed the cholesteric phase and an increase in viscosity.

Cellulose solution containing water (23.5/74.5/2.0) showed a more rapid increase in negative specific rotation with increasing storage time compared with the solution prepared from solvent containing no water (25.5/74.5).

The turbidity of the cellulose solution increased with increasing deviation in either direction from the solvent composition 24.5/75.5. Increasing storage time increased the turbidity of the solutions prepared from solvent containing either more or less than 75.5% $NH_4SCN$. There was no noticeable change in the turbidity of the solution prepared in solvent containing approximately 75.5% $NH_4SCN$.

Increasing the cellulose concentration in the solvent composition containing less than approximately 75.5% $NH_4SCN$ caused an increase in the specific rotation. The turbidity also increased with an increase in cellulose concentration in the same solvent composition range. At moderate cellulose concentrations, 12g/100mL–16g/100mL, the solutions prepared from solvent containing approximately 75.5% $NH_4SCN$ displayed thread-like patterns, while at higher cellulose concentration, 18g/100mL, it displayed the conjugated pattern.

It was possible to temporarily induce a cellulose solution that displayed one kind of pattern to display another by freezing the solution and then thawing. The spherulitic pattern existing at 25° C. was transformed into a uniformly dispersed highly birefringent pattern by chilling to −78° C., at which temperature the cellulose solution was frozen. The uniformly dispersed highly birefringent pattern became spherulitic again when the sample was left at 25° C. for 10 minutes. In comparison, the cellulose solution prepared from solvent having lower $NH_4SCN$ contents, 70–71%, and which displayed a small pitch finger print pattern, persisted without any change in pattern when similarly treated.

Cholesteric Pitch

The cholesteric structure consists of a set of quasi-nematic layers whose individual directors are turned through a fixed angle from one layer to the next. The layers which are turned through 360 degrees are equivalent, and the distance between these particular layers is defined as the pitch of a helicoidal cholesteric structure.

Figure 8:
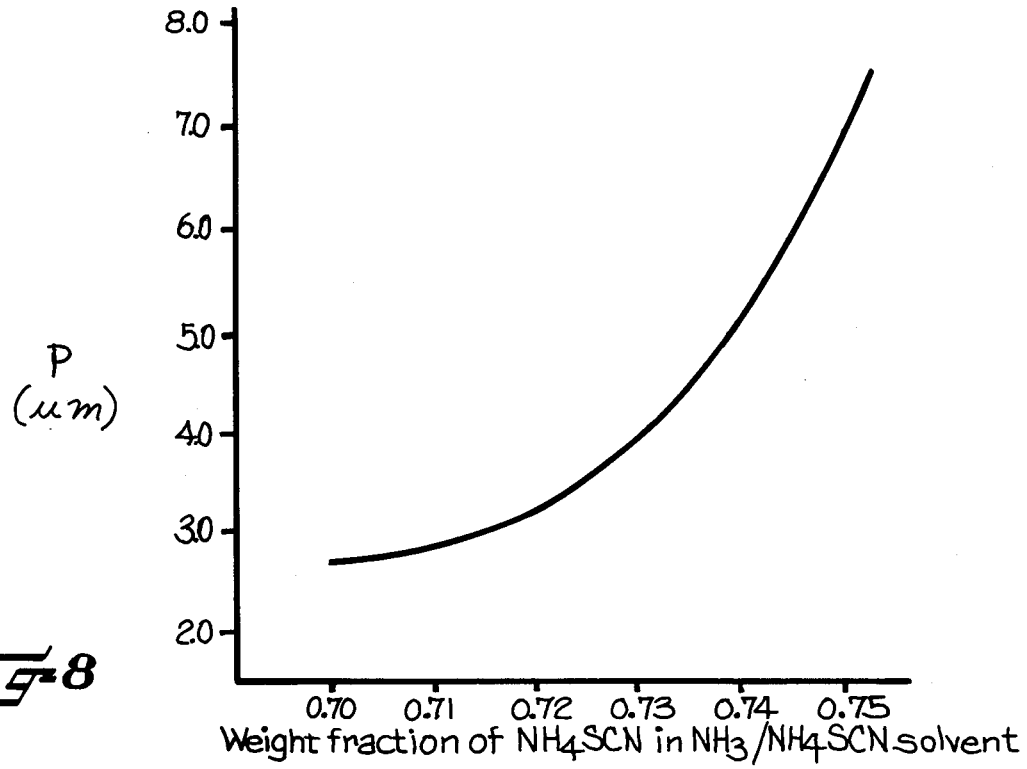
FIG. 8 is a graph showing the dependence of pitch size upon solvent composition.

In the range of solvent composition, approximately 29.3/70.7 to 25.0/75.0, the cellulose solutions showed the finger print pattern. The pitch size increased with increasing $NH_4SCN$ concentration and decreased with increasing cellulose concentration. FIG. 8 illustrates the effect of increasing pitch size with increasing $NH_4SCN$ concentration in the solvent. As the pitch size increases, conditions for the existence of the nematic phase, which would have infinite pitch, are being approached.

EXAMPLE 2—WET SPINNING OF FIBERS FORMED FROM ANISOTROPIC CELLULOSE SOLUTIONS

Fibers were formed from the cellulose solutions produced as described in Example 1 using a wet spinner (Bradford University Research Ltd.) for wet extrusion of the solutions from a 6 hole spinneret (hole diameter 0.23 mm).

Solutions at a cellulose concentration of 16g/100mL and at two different solvent compositions (29.3/70.7 and 25.0/75.0) were extruded using the wet spinner. Fibers extruded via this route showed good evenness and were suitable for tensile testing. Microscopic examination of the solutions by the techniques described in Example 1 show the solution from the 70.7% $NH_4SCN$ solvent to be in the cholesteric phase and the solution from the 75% $NH_4SCN$ solvent to be in the nematic phase.

Figure 9:
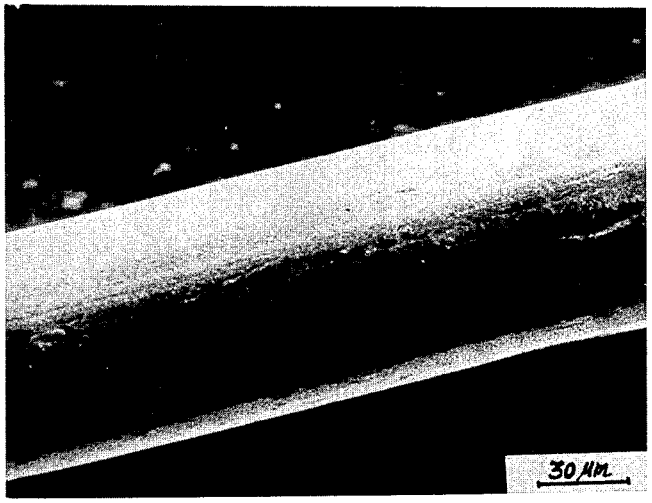
Figure 10:
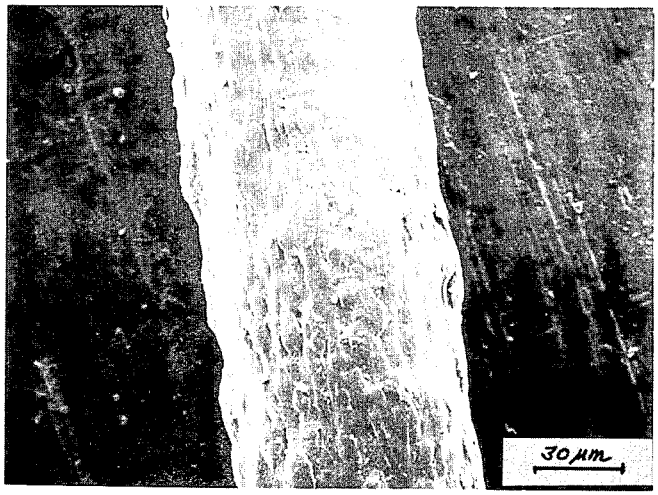

The properties and appearance of fibers formed from the nematic solution (solvent composition 25/75) were greatly different from those of fibers derived from the cholesteric solution (solvent composition 29.3/70.7). Fiber property dependence on the solvent composition is tabulated in Table I. The tenacity and modulus of fiber obtained from the former solvent composition were almost twice those of the fiber from the latter solvent composition. The surface of the fiber from the solvent composition 25/75 was relatively smooth (FIG. 9) compared with fiber from the solvent composition 29.3/70.7 (FIG. 10). Inspection of the fracture of each fiber revealed that the fibers from the solvent composition 25/75 are more longitudinally oriented compared with the fibers from the solvent composition 29.3/70.7.

Table I. The effects of solvent composition on fiber properties.

| $NH_3/NH_4SCN$ | DP | C (g/100 mL) | Denier | Tenacity (g/d)* | Modulus (g/d)* | Birefringence |
|---|---|---|---|---|---|---|
| 29.3/70.7 | 210 | 16 | 98 | 0.56 | 24.4 | Low |
| 25.0/75.0 | 210 | 16 | 110 | 0.98 | 44.0 | High |

*g/d = grams per denier

Figure 11:
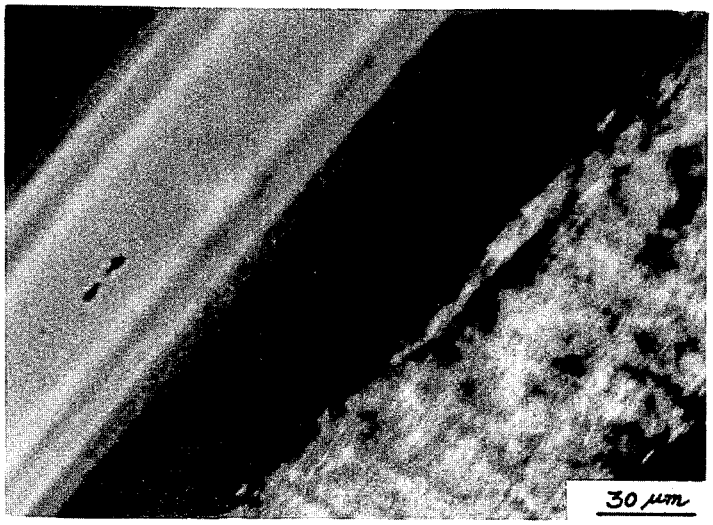
FIG. 11 is a photomicrograph taken with polarized light comparing two fibers produced from cellulose mesophase solutions in the nematic and cholesteric phases, respectively: solvent compositions: 25.0/75.0 $NH_3/NH_4SCN$ (left), 29.3/70.7 $NH_3/NH_4SCN$ (right), (cellulose concentration 16g/100mL, cellulose DP 210)
Figure 12:
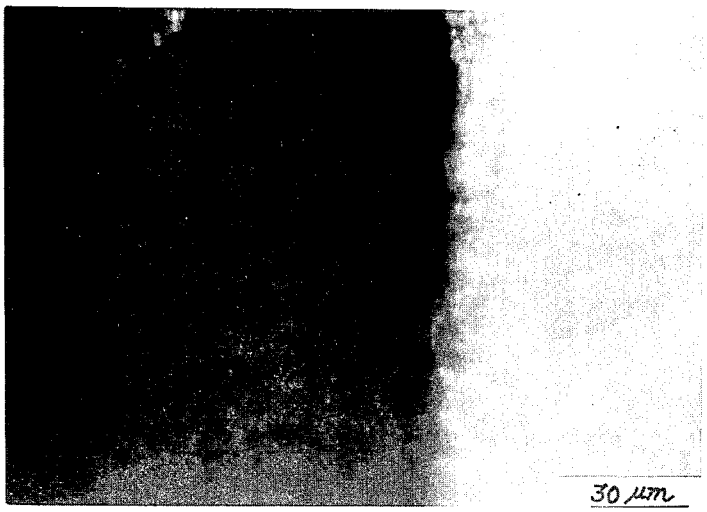
FIG. 12 is a polarized microscopical comparison of the fibers of FIG. 11 rotated 45° from FIG. 11 and showing the light extinction of the fiber spun from the nematic solution (left) which is an indication of unidirectional molecular orientation.

When compared under a polarizing microscope, the two fibers prepared from both solvent compositions showed distinct differences (FIGS. 11 and 12). The fiber from solvent composition 25/75 appeared to be more longitudinally oriented than the fiber from the solvent composition 29.3/70.7, as evidenced by the light extinction of the fiber spun from the nematic solution when both fibers were rotated 45 degrees in the polarized light (FIG. 12).

The fiber properties given, because of the relatively crude fiber formation process used, are not intended to represent or limit the ultimate high values obtainable. This example does demonstrate, however, that even under the inelegant method of extrusion employed, fibers derived from the cellulose solution exhibiting the nematic phase are essentially twice as strong and twice as stiff as those derived from the cellulose solution in the cholesteric phase.

EXAMPLE 3—DRY-JET WET SPINNING OF FIBERS FORMED FROM ANISOTROPIC CELLULOSE SOLUTIONS

A nematic cellulose mesophase solution containing 14g/100 mL of cellulose (*$DP_w$=765) was dry-jet wet spun using a small scale spinning device. The properties of the fiber so produced are compared in Table II with those of one formed from a cholesteric solution (Example 2) and with those of Fortisan ®.

*$DP_w$=degree of polymerization determined from weight average molecular weight

TABLE II

COMPARISONS AMONG CELLULOSE FIBERS PRODUCED FROM MESOPHASES AND FORTISAN ®

| | Fiber Source | | |
|---|---|---|---|
| | $NH_3/NH_4SCN$ | | |
| Characteristic | 24.5/75.5 | 29.3/70.7 | Fortisan ® |
| DP | 765 | 210 | |
| Spinning method | dj-ws* | ws** | |
| Spun from conc. g/100 mL | 14 | 16 | |
| Linear density, d/f | 8.55 | 98 | |
| Tenacity | | | |
| dry, g/d | 2.98 | 0.56 | 6–8 |
| wet, % of dry | 73 | | 75–85 |
| Elongation, dry % | 8 | | |
| Elongation, wet % | 9 | | |
| Initial modulus g/d | 167 | 22.9 | 170–250 |
| Birefringence | high | low | |

*dry jet-wet spun
**wet spun

It is at once evident that there is a significant difference in properties of fibers made from each of the two mesophase types. The fiber formed from the nematic mesophase has a modulus (167 g/d). This modulus is very close to the lower part of the range typical of Fortisan ®, which is widely considered to be a stiff, strong regenerated cellulose fiber. It is recognized that tensile strength or breaking strength in the early stages of fiber development depends greatly on processing conditions. Modulus, on the other hand, is not so strongly related to processing conditions. As a result, the moduli of even crudely prepared fibers might be expected to be high, probably close to the ultimately expected value. However, these extrusions represent first attempts to prepare fibers from these anisotropic solutions. While the results are promising, more refined techniques should yield even greater values.

EXAMPLE 4—PREPARATION OF CELLULOSIC FILM FROM ANISOTROPIC CELLULOSE SOLUTION

A cholesteric liquid crystalline solution was made from cellulose of DP210 in 25/75 (w/w) $NH_3/NH_4SCN$ at a concentration of 20g/100mL. The cellulose solution was poured on a glass plate. A glass rod was placed upon and pushed over the solution to give a thin film. The thickness of the film was controlled by two lengths of Scotch tape serving as spacers, placed parallel to each other on both sides of the glass plate. The glass plate with the cellulose solution was then put into a methanol coagulation bath for about 10 minutes, followed by washing in running water for 20 minutes to remove all $NH_4SCN$. The coagulated film was then lifted from the glass plate and mounted on a square and left at room temperature until dry.

Table III gives the properties of the cellulosic film produced from the anisotropic solution and those of a commercial cellophane. The data show that the film formed from a cholesteric liquid crystalline cellulose solution has tensile strength and modulus in the range of that of commercial cellophane. Since cellophane is primarily cellulose regenerated from viscose and extruded into sheet form, the structure and properties of cellophane are influenced strongly by the process of manufacture which is usually complex and costly. In contrast, the preparation of cellulosic films from an anisotropic solution of cellulose in $NH_3/NH_4SCN$ may prove to be simple and potentially relatively inexpensive.

TABLE III

Properties of the Cellulosic Films

| | Cellulosic Film From Anisotropic Solution | | |
|---|---|---|---|
| Property* | Parallel to the Shearing Direction | Normal to the Shearing Direction | Commercial Cellophane** |
| Elongation, % | 8 | 5 | 10–35 |
| Tensile Strength psi | $12 \times 10^3$ | $9.7 \times 10^3$ | $6 \times 10^3$–$18 \times 10^3$ |
| Modulus of Elasticity, psi | $6.6 \times 10^5$ | $5.7 \times 10^5$ | $2 \times 10^5$–$8 \times 10^5$ |
| Mullen Burst Strength, psi (for 1 mil) | 30 | | 25–100 |
| Moisture Content, % | 7 | | 10–15 |
| Moisture regain, % | 7.6 | | 12–14 (Rayon) |

*Test Condition: 70° F., 65% relative humidity
**The properties of commercial cellophanes depend on the manufacturing process and additives That which we claim is:

1. A cellulose fiber formed from a lyotropic mesophase solution of cellulose in an ammonia/ammonium thiocyanate solvent.

2. The article according to claim 1 wherein said lyotropic mesophase solution exhibits the nematic phase.

3. A cellulosic film formed from a lyotropic mesophase solution of cellulose in an ammonia/ammonium thiocyanate solvent.

4. A process for forming a lyotropic cellulose mesophase solution which comprises dissolving cellulose at a concentration of at least 3.5g/100mL in an ammonia/ammonium thiocyanate solvent having a concentration of ammonium thiocyanate of about 70 percent by weight or greater.

5. A process according to claim 4 wherein said solvent has a concentration of about 75 percent by weight ammonium thiocyanate.

6. A process for selectively forming a lyotropic cellulose mesophase solution in the nematic phase which comprises dissolving cellulose in an ammonia/ammonium thiocyanate solvent having a composition of 24.5 percent ammonia and 75.5 percent ammonium thiocyanate.

7. A process according to claim 6 wherein said solution has a cellulose concentration within the range of about 8g/100mL to about 16g/100mL.

8. A process for producing high tenacity, high modulus cellulosic fibers which comprises forming a lyotropic mesophase solution of cellulose in the nematic phase and extruding said solution into a coagulation bath to form fibers therefrom.

9. The process according to claim 8 wherein said lyotropic mesophase solution of cellulose comprises a solution of cellulose in an ammonia/ammonium thiocyanate solvent.

10. The process according to claim 9 wherein said ammonia/ammonium thiocyanate solvent has a composition of about 24.5 percent by weight ammonia and about 75.5 percent by weight ammonium thiocyanate.

11. A process according to claim 10 wherein said cellulose solution has a cellulose concentration within the range of about 8g/100mL to about 16g/100mL.

12. A process for producing high tenacity, high modulus cellulosic films which comprises forming a lyotropic mesophase solution of cellulose in an ammonia/ammonium thiocyanate solvent and forming a film therefrom by casting.

13. A cellulose article formed from a lyotropic mesophase solution of cellulose in an ammonia/ammonium thiocyanate solvent.

14. The article according to claim 13 in the form of a fiber.

15. The article according to claim 13 in the form of a film.

16. A cellulose article formed from a lyotropic mesophase solution of cellulose produced in accordance with claim 4.

17. A cellulose article formed from a lyotropic mesophase solution of cellulose produced in accordance with claim 6.

18. A cellulose fiber produced by the process of claim 8.

19. A cellulose fiber produced by the process of claim 9.

20. A cellulose fiber produced by the process of claim 10.

21. A cellulose fiber produced by the process by claim 11.

22. A cellulose film produced by the process of claim 12.

* * * * *

UNITED STATES PATENT AND TRADEMARK OFFICE

CERTIFICATE OF CORRECTION

PATENT NO. : 4,840,673

DATED : June 20, 1989

INVENTOR(S) : John A. Cuculo, et al.

It is certified that error appears in the above-identified patent and that said Letters Patent is hereby corrected as shown below:

Column 1, line 7, "12/02/88" should be -- 12/02/86 --

Column 1, line 19, after "modulus" insert -- . --

Column 1, line 38, "to" should be -- of --

Column 1, line 68, "o" should be -- of --

Column 6, line 10, after "cholesteric" insert -- . --

Column 6, line 24, after "rotation" insert -- . --

Column 6, line 55, "$NH_3/NH.SCN_4$" should be -- $NH_3/NH_4SCN$ --

Column 7, lines 16 and 17, after "concentration" delete ".", and 8 0 should be -- 8.0 --

Signed and Sealed this

Seventeenth Day of April, 1990

*Attest:*

HARRY F. MANBECK, JR.

*Attesting Officer*

*Commissioner of Patents and Trademarks*